US007069885B2

(12) United States Patent
Iida

(10) Patent No.: US 7,069,885 B2
(45) Date of Patent: Jul. 4, 2006

(54) CYLINDER HEAD

(75) Inventor: Makoto Iida, Fujisawa (JP)

(73) Assignee: Isuzu Motors Limited, Tokyo (JP)

( * ) Notice: Subject to any disclaimer, the term of this patent is extended or adjusted under 35 U.S.C. 154(b) by 0 days.

(21) Appl. No.: 10/510,558

(22) PCT Filed: Apr. 9, 2003

(86) PCT No.: PCT/JP03/04496

§ 371 (c)(1),
(2), (4) Date: Oct. 7, 2004

(87) PCT Pub. No.: WO03/085250

PCT Pub. Date: Oct. 16, 2003

(65) Prior Publication Data

US 2005/0145204 A1 Jul. 7, 2005

(30) Foreign Application Priority Data

Apr. 11, 2002 (JP) ..... 2002-109077

(51) Int. Cl.
*F02F 1/36* (2006.01)

(52) U.S. Cl. ..... 123/41.82 R

(58) Field of Classification Search ..... 123/41.82 R, 123/41.31

See application file for complete search history.

(56) References Cited

U.S. PATENT DOCUMENTS 5,975,032 A * 11/1999 Iwata ..... 123/41.31

FOREIGN PATENT DOCUMENTS

| | | |
|---|---|---|
| JP | 57-31544 | 2/1982 |
| JP | 62-159750 | 7/1987 |
| JP | 63-132827 | 8/1988 |

OTHER PUBLICATIONS

Copy of PCT Search Report for Serial No. PCT/JP03/04496 dated Jul. 1, 2003.

* cited by examiner

*Primary Examiner*—Tony M. Argenbright
*Assistant Examiner*—Katrina Harris
(74) *Attorney, Agent, or Firm*—McCormick, Paulding & Huber LLP

(57) ABSTRACT

A cooling water pipe is deformed so as to have outlet openings respectively placed in a position around a fuel injection nozzle and in a position between ports, and the cooling water pipe is inserted to be placed inside the cylinder head. Thereby, the position around the fuel injection nozzle and the position between the ports can be simultaneously and efficiently cooled, and the structure becomes simpler and the production becomes easier. In order to deform the cooling water pipe, for example, the cooling water pipe is bent first, and subsequently bulge forming by hydraulic pressure is performed. Preferably, the cooling water pipe is made of aluminum. Thereby, the cooling water pipe becomes easier to melt into when the cylinder head is cast.

15 Claims, 3 Drawing Sheets

CYLINDER HEAD

This application is entitled to the benefit of and incorporates by reference essential subject matter disclosed in Japanese Patent Application No. 2002-109077 filed on Apr. 11, 2002 and PCT application No. PCT/JP03/04496 filed Apr. 9, 2003.

TECHNICAL FIELD

This invention relates to a cylinder head of an internal combustion engine, and in particular, a cylinder head of an internal combustion engine in which both a position around a fuel injection nozzle and a position between ports can be simultaneously and efficiently cooled.

BACKGROUND ART

FIG. 5 is a sectional view of a conventional cylinder head. In FIG. 5, 101 is a hole for attachment of a fuel injection nozzle, 102 is an intake port, 103 is an exhaust port, and 104 is a water jacket. As shown in FIG. 5, a position around the fuel injection nozzle and a position between ports are cooled by cooling water in the water jacket 104. In the cylinder head shown in FIG. 5, the cooling water which flows into the cylinder head from the cylinder block (not shown) is made to flow into one big room (water jacket 104). Consequently, the flow velocity of the cooling water in the water jacket 104 becomes relatively slow (approximately 1 m/sec). It is no problem if the cylinder head shown in FIG. 5 is applied to a relatively low-power engine. However, if the cylinder head shown in FIG. 5 is applied to a relatively high-power engine, it is possible that cooling performance lacks and the cylinder head cracks by temperature rise at the lower surface of the cylinder head.

In order to solve this problem, such a cylinder head is known that the water jacket is divided into two, one of which is in a lower surface side of the cylinder head and another of which is in an upper surface side of the cylinder head. There is an example of this kind of cylinder head that is described in Japanese laid-open Patent Application No. 2000-34950. FIG. 6 is a sectional view of the cylinder head having the water jacket divided into the lower surface side of the cylinder head and the upper surface side of the cylinder head. In FIG. 6, 201 is a hole for attachment of the fuel injection nozzle, 202 is an intake port, 203 is an exhaust port, 204 is a water jacket in the lower surface side of the cylinder head, and 205 is a water jacket in the upper surface side of the cylinder head. In the cylinder head shown in FIG. 6, in view of point that the lower side of the cylinder head is more necessary to be cooled than the upper side of the cylinder head, the cross-sectional area of the water jacket 204 in the lower surface side of the cylinder head is made relatively small, and the cross-sectional area of the water jacket 205 in the upper surface side of the cylinder head is made relatively large. That is, the flow velocity of the cooling water in the water jacket 204 in the lower surface side of the cylinder head is higher than the flow velocity of the cooling water in the water jacket 205 in the upper surface side of the cylinder head. The flow velocity of the cooling water in the water jacket 205 in the lower surface side of the cylinder head becomes approximately 3 m/sec. Therefore, the lower surface side of the cylinder head can be efficiently cooled.

Also in the cylinder head in which the lower surface side can be efficiently cooled, it is known that it is more necessary to cool a side near the fuel injection nozzle than a side apart from the fuel injection nozzle among the circumference of the port. FIG. 7 is a perspective view of an example of the water jacket in the lower surface side of the cylinder head. In FIG. 7, 301 is a fuel injection nozzle part and 302 is a port part. The cooling water flows inside the water jacket in the lower surface side of the cylinder head as shown by arrow in the figure. In the water jacket in the lower surface side of the cylinder head shown in FIG. 7, in view of point that the side near the fuel injection nozzle part 301 is more necessary to be cooled than the side apart from the fuel injection nozzle part 301 among the circumference of the port, the cross sectional area of the water jacket which is in the side apart from the fuel injection nozzle part 301 (part A in the figure) among the circumference of the port part 302 is reduced so that the cooling water is hard to flow in the side apart from the fuel injection nozzle part 301 among the circumference of the port part 302. However, to reduce the cross sectional area of the water jacket means to make the cross sectional area of the sand core used for casting of the cylinder head small. Therefore, it is possible that the core breaks when set before the casting of the cylinder head, and that the core is damaged by the pressure of the molten metal during the casting.

In order to solve this problem, traditionally, such a cylinder head is known that a cooling water pipe as a cooling water passage is located inside of the cylinder head. There is an example of this kind of the cylinder head that is described in Japanese laid-open Patent Application No. 2000-170600. In the cylinder head described in the Japanese laid-open Patent Application No. 2000-170600, a cooling water passage is formed around the exhaust port. In detail, the cooling water passage is formed inside each exhaust valve seat. The cooling water passages which are respectively around a pair of exhaust ports being next to each other are communicated with each other by a pipe. An outlet opening is formed in the pipe, and the cooling water flowing into the pipe from the cooling water passage in the exhaust valve seat is discharged outside of the pipe through the outlet opening. That is, the cooling water in the pipe is discharged toward a position between the pair of adjoining exhaust ports.

However, in the cylinder head described in the Japanese laid-open Patent Application 2000-170600, no outlet opening of the pipe for the cooling water is provided around the fuel injection nozzle, although break or damage of the core when casting of the cylinder head are avoided since the cooling water pipe as a cooling water passage is placed inside the cylinder head. Therefore, in the cylinder head described in the Japanese laid-open Patent Application 2000-170600, a position around the fuel injection nozzle and a position between ports cannot be efficiently, simultaneously cooled.

And also, in the cylinder head described in the Japanese laid-open Patent Application 2000-170600, one cooling water pipe is necessary to cool the position between the pair of adjoining ports. That is, two or more cooling water pipes are necessary to cool each position between each pair of adjoining ports among a plurality of pairs of adjoining ports. That is, in the case that there are two exhaust ports and two intake ports in one cylinder, and that the position between the pair of adjoining exhaust ports and the position between the exhaust port and the intake port which adjoin each other intend to be cooled, a plurality of cooling water pipes are required. Therefore, the structure of the cylinder head will become complicated and the casting process of the cylinder head will become complicated.

Therefore, it is an object of this invention to provide a cylinder head in which the position around the fuel injection nozzle and the position between ports can be efficiently and simultaneously cooled, and the structure of which is simpler and the production of which is easier than the cylinder head described in the Japanese laid-open Patent Application 2000-170600.

DISCLOSURE OF INVENTION

An embodiment of this invention is provided with a cylinder head having a cooling water pipe inside, wherein the cooling water pipe is inserted and has outlet openings respectively placed in a position around a fuel injection nozzle and in a position between ports.

In this cylinder head, the outlet openings of the cooling water pipe are respectively placed in the position around the fuel injection nozzle and in the position between the ports. Therefore, unlike the cylinder head described in the Japanese laid-open Patent Application 2000-170600 in which no outlet opening of the cooling water pipe is placed in the position around the fuel injection nozzle, the position around the fuel injection nozzle and the position between the ports can be simultaneously and efficiently cooled. Furthermore, the cooling water pipe is deformed such that the cooling water pipe has the outlet openings respectively placed in the position around the fuel injection nozzle and in the position between the ports. That is, the cooling water pipe deformed extends through the position around the fuel injection nozzle and the position between the ports. Therefore, providing the cooling water pipe with the outlet openings which are respectively placed between respective pairs of adjoining ports for example, it is possible for one cooling water pipe to cool not only the position between a pair of adjoining exhaust ports but also the position between the exhaust port and the intake port adjoining each other. That is, the structure becomes simpler and thus the production becomes easier than the cylinder head described in the Japanese laid-open Patent Application 2000-170600 which requires two or more cooling water pipes to cool each position between adjoining ports of two or more pairs of ports.

As described above, unlike the cylinder head described in the Japanese laid-open Patent Application 2000-170600 in which no outlet opening of the cooling water pipe is provided in the position around the fuel injection nozzle, the position around the fuel injection nozzle and the position between the ports can be simultaneously and efficiently cooled. Furthermore, providing the cooling water pipe with the outlet openings which are respectively placed between respective pairs of the adjoining ports for example, it is possible for one cooling water pipe to cool not only the position between a pair of adjoining exhaust ports but also the position between the exhaust port and the intake port adjoining each other. That is, the structure becomes simpler and thus the production becomes easier than the cylinder head described in the Japanese laid-open Patent Application 2000-170600 which requires two or more cooling water pipes to cool each position between adjoining ports of two or more pairs of ports.

Moreover, an embodiment of the invention such that the cooling water pipe extends from an inlet opening to the outlet opening without passing through a valve seat.

As mentioned above, in the cylinder head described in the Japanese laid-open Patent Application 2000-170600, the cooling water passage is defined in the valve seat and the cooling water pipe is extended therefrom. Therefore, in the valve seat of the cylinder head described in the Japanese laid-open Patent Application 2000-170600, a positioning for precisely fitting with the valve and a positioning for precisely fitting with the cooling water pipe are necessary. That is, in the cylinder head described in the Japanese laid-open Patent Application 2000-170600, there is a possibility that the valve does not precisely sit on the valve seat if it is intended to prevent a leak of the cooling water from a connection part between the valve seat and the cooling water pipe. In view of this problem, the cooling water pipe extends from the inlet opening to the outlet opening without passing through the valve seat. Therefore, the problem involved in the cylinder head described in the Japanese laid-open Patent Application 2000-170600 can be avoided.

As described above, the problem involved in the cylinder head described in the Japanese laid-open Patent Application 2000-170600 that the positioning for precisely fitting with the valve and the positioning for precisely fitting with the cooling water pipe are required for the valve seat can be avoided.

Moreover, an embodiment of the invention is such that the cooling water pipe is made of aluminum.

In such an embodiment, the cooling water pipe made of aluminum is inserted in the cylinder head. Therefore, compared with the case that the cooling water pipe made of another material is inserted, the cooling water pipe easily melts into the cylinder head. That is, it can be prevented that the cooling water pipe inserted dissociates from the cylinder head.

More specifically, the cooling water pipe deformed is inserted in a part of the cooling water passage which is necessary to be cooled most but only has a relatively small cross sectional area of the cooling water passage. Thereby, the cross sectional area of the cooling water passage is secured, and it is avoided that the core is broken or damaged when the cylinder head is cast. When the cylinder head is cast, the cooling water pipe into which sand is filled is set, and subsequently the sand is filled in the mold for making the cooling water passage (water jacket).

Preferably, the sand in the cooling water pipe collapses during heat process to be removed, for example. Moreover, in order to deform the cooling water pipe, the cooling water pipe is bent first and then a bulge forming is performed by hydraulic pressure etc.

As described above, the cooling water pipe made of aluminum easily melts into the cylinder head, compared with the case that the cooling water pipe made of another material is inserted. That is, can be prevented that the cooling water pipe inserted dissociates from the cylindern head.

BEST MODE FOR CARRYING OUT THE INVENTION

An embodiment of this invention will now be described with reference to accompanying drawings.

In FIG. 1–4, 1 is a cooling water pipe, 2 is a fuel injection nozzle, 3 is a port, 4 is an outlet opening placed in a position between ports for cooling the position between the ports, and 5 and 6 are outlet openings placed in a position around the fuel injection nozzle 2 for cooling the position around the fuel injection nozzle. 7 and 8 are inlet openings for supplying cooling water to the outlet openings 4, 5 and 6. 9 is a hole for attachment of the fuel injection nozzle, and 10 is a valve seat insert.

Figure 1:
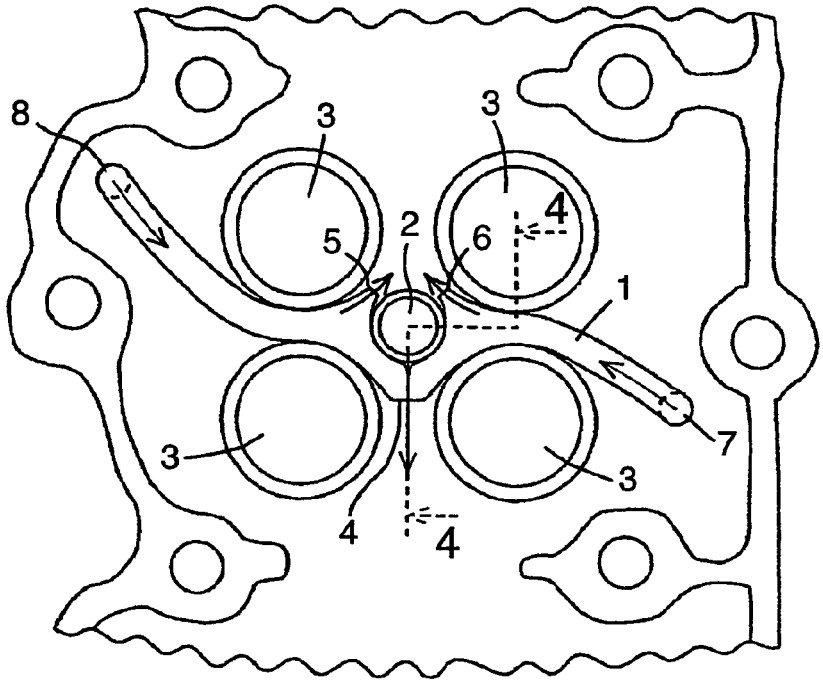
FIG. 1 is a schematic diagram showing a structure of one embodiment of a cylinder head of this invention.
Figure 3:
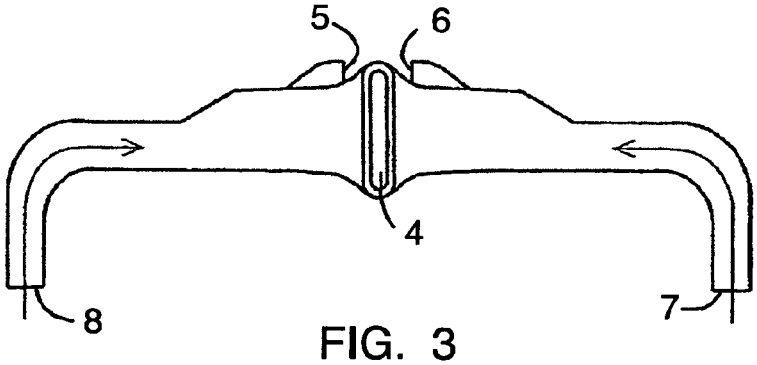
FIG. 3 is a front elevation view of the cooling water pipe shown in FIG. 1.
Figure 4:
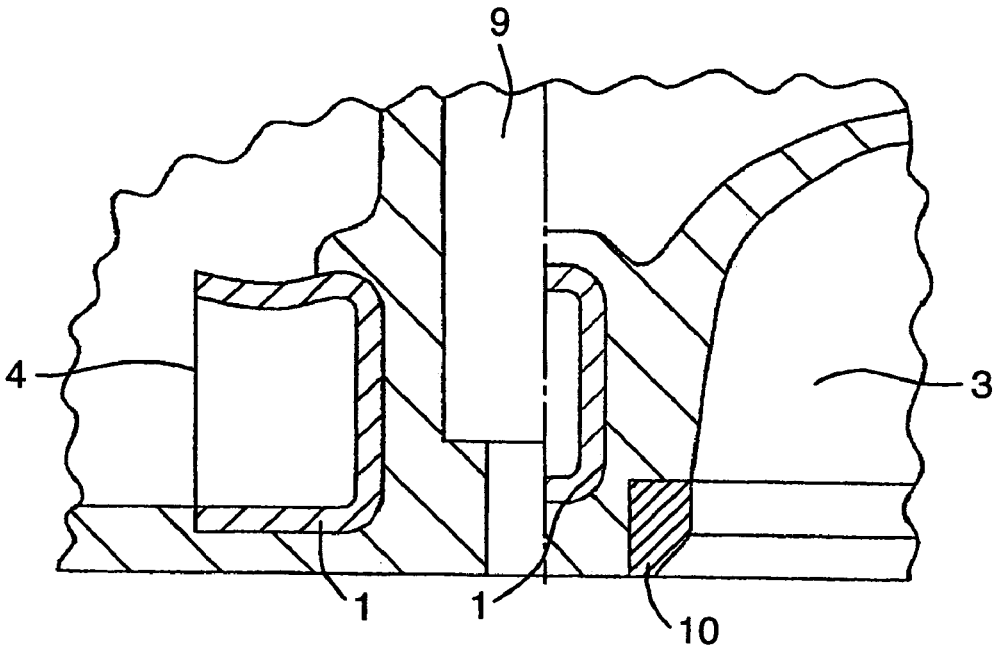
FIG. 4 is a sectional view taken along a line IV—IV of FIG. 1.
Figure 5:
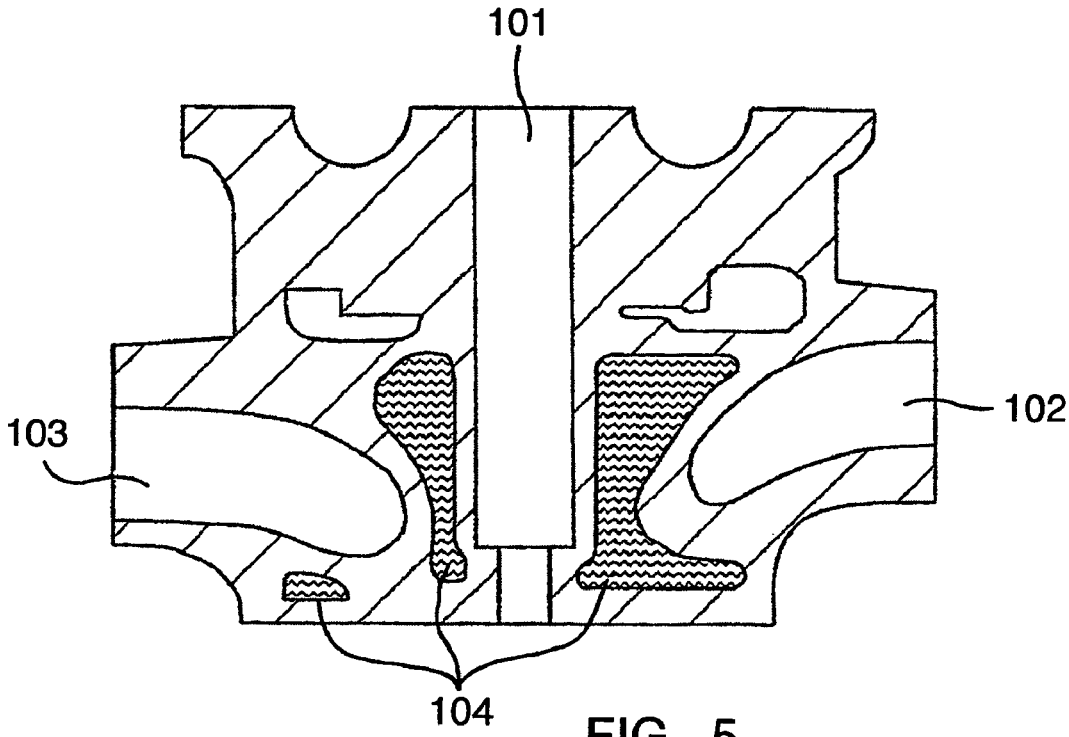
FIG. 5 is a sectional view of the conventional cylinder head.
Figure 6:
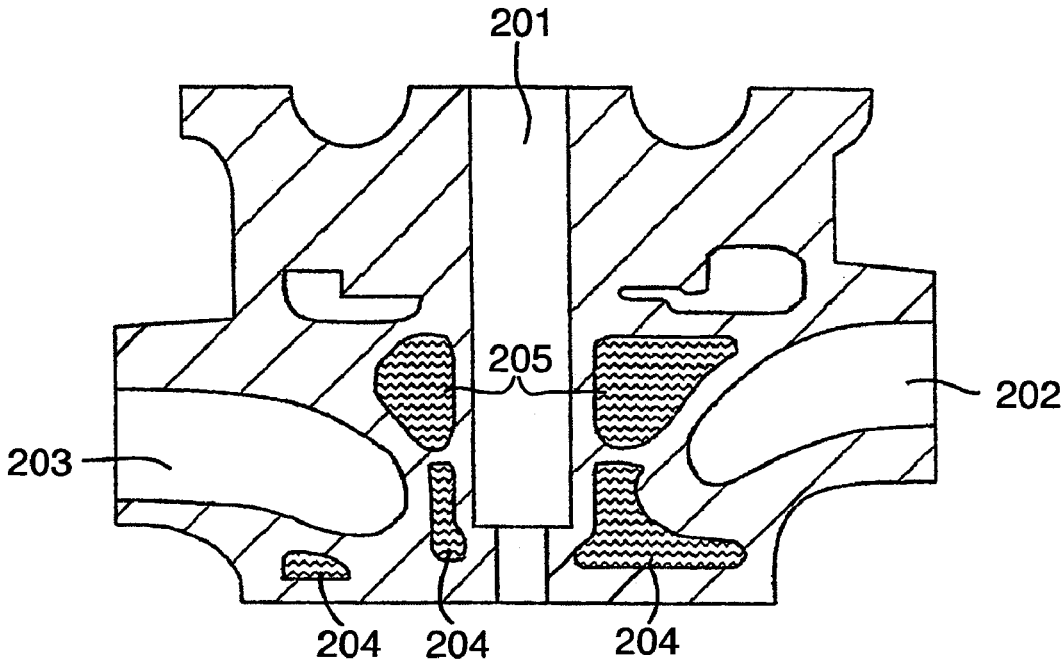
FIG. 6 is a sectional view of the cylinder head in which the water jacket is divided into one part in the lower surface side of the cylinder head and another part in the upper surface side of the cylinder head.
Figure 7:
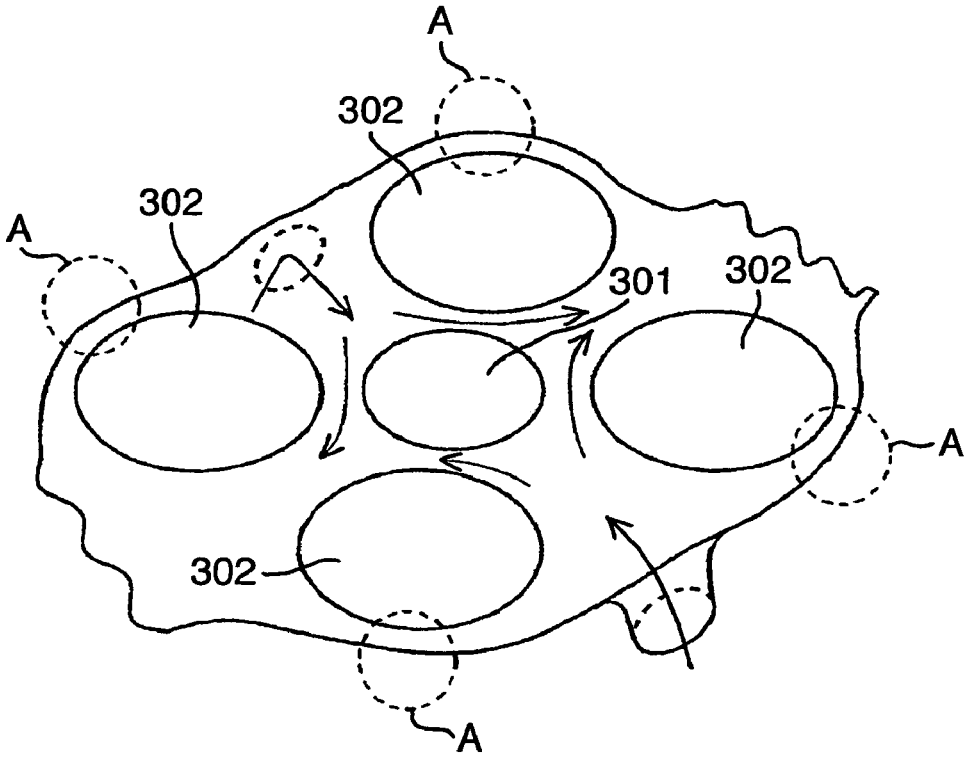
FIG. 7 is a perspective view of an example of the water jacket in the lower surface side of the cylinder head.

As shown in FIGS. 1 and 4, in the cylinder head of this embodiment, the cooling water pipe 1 is inserted (or cast in or embedded) to be placed inside the cylinder head. Moreover, one cooling water pipe 1 is placed per cylinder. The cooling water pipe 1 is provided with the inlet openings 7 and 8 for supplying the cooling water into the cooling water pipe 1, and the outlet openings 4, 5, and 6 for discharging the cooling water out of the cooling water pipe 1. The cooling water pipe 1 is deformed into a bent form such that the position between the ports 3 can be cooled by the cooling water discharged from the outlet opening 4 and that the position around the fuel injection nozzle 2 can be cooled by the cooling water discharged from the outlet openings 5 and 6. In order to deform the cooling water pipe 1 as shown in FIGS. 2 and 3, the cooling water pipe with a straight form is bent first, and subsequently, a bulge forming with a hydraulic pressure etc. is performed.

Figure 2:
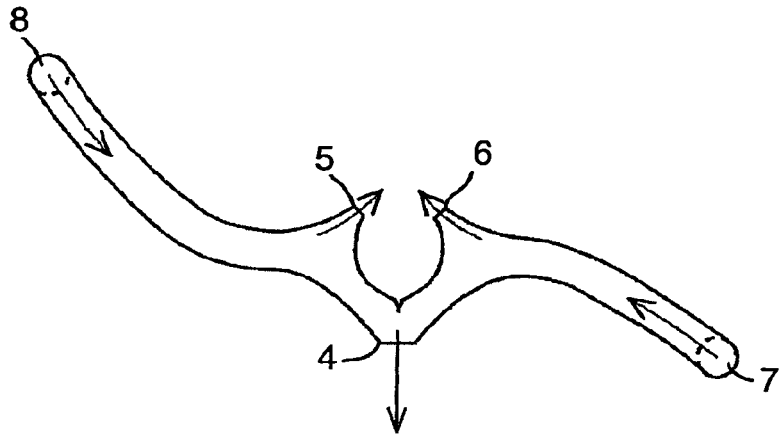
FIG. 2 is a plan view of the cooling water pipe shown in FIG. 1.

As shown in FIGS. 1–3, the cooling water sent from the cylinder block (not shown) is supplied into the cooling water pipe 1 through the inlet openings 7 and 8. A part of the cooling water is discharged from the outlet opening 4 to the position between the ports 3, and the position between the ports 3 is cooled by the cooling water. And also, another part of the cooling water supplied into the cooling water pipe 1 is discharged from the outlet openings 5 and 6 to the position around the fuel injection nozzle 2, and the position around the fuel injection nozzle 2 is cooled by the cooling water.

When the cylinder head of this embodiment is cast, firstly the cooling water pipe 1 filled with sand is set in a mold. Positioning of the cooling water pipe 1 is carried out by portions respectively having the inlet openings 7 and 8 (refer to FIG. 3). That is, in the cooling water pipe 1 of this embodiment, the portions in which the inlet openings 7 and 8 are respectively provided serve as the portions for positioning the cooling water pipe 1 when casting. Subsequently, the sand is filled for making the other part of the cooling water passage than the cooling water pipe 1. The sand inside the cooling water pipe 1 collapses during a heat process to be removed. That is, in the cylinder head of this embodiment, the cooling water pipe deformed is inserted in such a part of the cooling water passage that is most necessary to be cooled but only has a relatively small cross sectional area of the cooling water passage. Thereby, the cross sectional area of the cooling water passage is secured, and it is avoided that the core is broken or damaged when the cylinder head is cast.

The cooling water pipe 1 of this embodiment is made of aluminum. Accordingly, the cooling water pipe 1 easily melts into the cylinder head when the cylinder head (which is made of material such as aluminum alloy) is cast. However, in another embodiment, it is also possible to make the cooling water pipe by using material other than aluminum.

As described above, according to this embodiment, the outlet opening 4 of the cooling water pipe 1 is placed in the position around the fuel injection nozzle 2, and the outlet openings 5 and 6 of the cooling water pipe 1 are placed in the position between the ports 3. Therefore, unlike the cylinder head described in the Japanese laid-open Patent Application 2000-170600 in which the outlet opening of the cooling water pipe is not placed in the position around the fuel injection nozzle, the position around the fuel injection nozzle 2 and the position between the ports 3 can be simultaneously and efficiently cooled. Furthermore, according to this embodiment, one bent cooling water pipe 1 per cylinder is inserted which is deformed so as to have the outlet openings 4, 5 and 6 respectively placed in the position around the fuel injection nozzle 2 and the position between the port 3. Therefore, the structure becomes simpler and thus the production becomes easier than the cylinder head described in the Japanese laid-open Patent Application 2000-170600 which requires two or more cooling water pipes per cylinder to cool each position between adjoining ports of two or more pairs of ports.

This invention can be widely applied to an engine such as a diesel or gasoline engine of a water cooled type.

The invention claimed is:

1. A cylinder head comprising:

at least two ports, including at least one intake port and at least one exhaust port;

at least one fuel injection nozzle; and at least one cooling water pipe having a plurality of outlet openings;

wherein the cylinder head at least partially defines a water jacket at least partially surrounding the at least two ports and the at least one fuel injection nozzle, and the at least one cooling water pipe is arranged inside the water jacket such that the plurality of outlet openings are respectively placed in a position around the at least one fuel injection nozzle and in a position between at least two of the at least two ports.

2. The cylinder head as defined in claim 1, wherein the cooling water pipe extends from an inlet opening to the plurality of outlet openings without passing through a valve seat.

3. The cylinder head as defined in claim 1, wherein the cooling water pipe is made of aluminum.

4. The cylinder head as defined in claim 3, wherein material of the cylinder head is an aluminum alloy.

5. The cylinder head as defined in claim 1, wherein the cylinder head has only one cooling water pipe per cylinder.

6. The cylinder head as defined in claim 5, wherein the cooling water pipe comprises one section extending from one side of the cylinder head to a position near the fuel injection nozzle, and another section extending from another side of the cylinder head to a position near the fuel injection nozzle, the one section has one inlet opening for introducing cooling water at its end located in the one side of the cylinder head, and has one first outlet opening for discharging the cooling water to the position around the fuel injection nozzle and one second outlet opening for discharging the cooling water to the position between the ports at its end located near the fuel injection nozzle, and the another section has another inlet opening for introducing the cooling water at its end located in the another side of the cylinder head, and has another first outlet opening for discharging the cooling water to the position around the fuel injection nozzle and another second outlet opening for discharging the cooling water to the position between the ports at its end located near the fuel injection nozzle.

7. The cylinder head as defined in claim 6, wherein the one second outlet opening and the another second outlet opening are formed as one, integral opening, and the one first outlet opening and the another first outlet opening are formed as separate opening.

8. The cylinder head as defined in claim 6, wherein four ports are provided per cylinder and are arranged such that each of the ports is in each corner of a square, the fuel injection nozzle is placed in an approximate middle position of the four ports, the one section of the cooling water pipe is placed between two ports among the four ports, and the another section of the cooling water pipe is placed between another two ports among the four ports.

9. The cylinder head as defined in claim 6, wherein the ends of the one section and the another section of the water cooling pipe which are located near the fuel injection nozzle are formed such that the ends generally surround the fuel injection nozzle.

10. A cylinder head comprising:

four ports arranged such that each of the ports is in each corner of a square;

at least one fuel injection nozzle placed in an approximate middle position of the four ports; and at least one cooling water pipe having a plurality of outlet openings respectively placed in a position around a fuel injection nozzle and in a position between the ports:

wherein the cylinder head at least partially defines a water jacket at least partially surrounding the four ports and the at least one fuel injection nozzle, and the at least one cooling water piper is arranged inside the water jacket and the cooling water pipe comprises one section extending from one side of the cylinder head to a position near the fuel injection nozzle through a position between two ports among the four ports, and another section extending from another side of the cylinder head to a position near the fuel injection nozzle through a position between another two ports among the four ports, the one section has one inlet opening for introducing cooling water at its end located in the one side of the cylinder head, and has one first outlet opening for discharging the cooling water to the position around the fuel injection nozzle and one second outlet opening for discharging the cooling water to the position between the ports at its end located near the fuel injection nozzle, and the another section has another inlet opening for introducing the cooling water at its end located in the another side of the cylinder head, and has another first outlet opening for discharging the cooling water to the position around the fuel injection nozzle and another second outlet opening for discharging the cooling water to the position between the ports at its end located near the fuel injection nozzle.

11. The cylinder head as defined in claim 10, wherein the one second outlet opening and the another second outlet opening are formed as one, integral opening, and the one first outlet opening and the another first outlet opening are formed as separate openings.

12. The cylinder head as defined in claim 11, wherein the ends of the one section and the another section of the water cooling pipe which are located near the fuel injection nozzle are formed such that the ends generally surround the fuel injection nozzle.

13. The cylinder head as defined in claim 12, wherein a position of the one inlet opening of the one section and a position of the another inlet opening of the another section differ from each other in a longitudinal direction of the cylinder head.

14. The cylinder head of claim 1, wherein the at least one cooling water pipe inside the water jacket is integral with the cylinder head.

15. The cylinder head of claim 10, wherein the at least one cooling water pipe inside the water jacket is integral with the cylinder head.

* * * * *